US010829832B2

(12) United States Patent
Padmarekha et al.

(10) Patent No.: US 10,829,832 B2
(45) Date of Patent: Nov. 10, 2020

(54) COMPRESSIVE RESIDUAL STRESS-HARDENED DOWNHOLE TOOL SHAFT REGION

(71) Applicant: Halliburton Energy Services, Inc., Houston, TX (US)

(72) Inventors: Venkkateesh Parthasarathi Padmarekha, Anna Nagar West (IN); Grant O. Cook, III, Spring, TX (US); Daniel Brendan Voglewede, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 229 days.

(21) Appl. No.: 15/571,098

(22) PCT Filed: Dec. 18, 2015

(86) PCT No.: PCT/US2015/066679

§ 371 (c)(1),
(2) Date: Nov. 1, 2017

(87) PCT Pub. No.: WO2016/195752

PCT Pub. Date: Dec. 8, 2016

(65) Prior Publication Data

US 2018/0171427 A1 Jun. 21, 2018

Related U.S. Application Data

(60) Provisional application No. 62/171,398, filed on Jun. 5, 2015, provisional application No. 62/171,393, filed on Jun. 5, 2015.

(51) Int. Cl.
*C21D 9/22* (2006.01)
*E21B 10/42* (2006.01)
(Continued)

(52) U.S. Cl.
CPC ..... *C21D 9/22* (2013.01); *C21D 1/06* (2013.01); *C21D 1/18* (2013.01); *C22C 29/005* (2013.01);
(Continued)

(58) Field of Classification Search
CPC .... C21D 9/22; C21D 1/18; C21D 1/06; C23C 8/68; C23C 8/70; C23C 8/20; C23C 8/22;
(Continued)

(56) References Cited

U.S. PATENT DOCUMENTS 6,312,832 B1 11/2001 Alperine et al.
8,220,563 B2 7/2012 Bangaru, et al.
(Continued)

FOREIGN PATENT DOCUMENTS

CN 101218413 7/2008
CN 101440451 5/2009
(Continued)

OTHER PUBLICATIONS

Hitchcock, G. R., et al. "Pin-hole and crack formation in a duplex stainless steel downhole tool." Engineering Failure Analysis 8.3 (2001): 213-226.*
(Continued)

*Primary Examiner* — Jessee R Roe
(74) *Attorney, Agent, or Firm* — Baker Botts, L.L.P.

(57) ABSTRACT

The disclosure provides downhole tools with shaft regions that are hardened by a compressive residual stress created when an allotropic material in a precursor region transforms from a first allotrope to a second allotrope in response to heat, while continuing to occupy the same physical space. The disclosure further provides methods of forming such downhole tools.

19 Claims, 5 Drawing Sheets

(51) Int. Cl.

| | |
|---|---|
| ***E21B 17/10*** | (2006.01) |
| ***C22C 29/00*** | (2006.01) |
| ***E21B 10/46*** | (2006.01) |
| ***E21B 10/54*** | (2006.01) |
| ***C21D 1/06*** | (2006.01) |
| ***C21D 1/18*** | (2006.01) |

(52) U.S. Cl.
CPC ..... *E21B 10/42* (2013.01); *E21B 10/46* (2013.01); *E21B 10/54* (2013.01); *E21B 17/1092* (2013.01); *C21D 2211/001* (2013.01); *C21D 2211/005* (2013.01)

(58) Field of Classification Search
CPC ... C23C 8/24; C23C 8/26; E21B 10/42; E21B 10/54
See application file for complete search history.

(56) References Cited

U.S. PATENT DOCUMENTS

| | | | | |
|---|---|---|---|---|
| 8,936,116 | B2 | 1/2015 | Lyons | |
| 2005/0269074 | A1* | 12/2005 | Chitwood ..... | C21D 1/06 166/217 |
| 2006/0180354 | A1 | 8/2006 | Belnap et al. | |
| 2006/0201718 | A1 | 9/2006 | Kembaiyan et al. | |
| 2010/0012392 | A1 | 1/2010 | Zahradnik et al. | |
| 2010/0187018 | A1 | 7/2010 | Choe et al. | |
| 2011/0094341 | A1 | 4/2011 | Choe et al. | |
| 2012/0273555 | A1 | 11/2012 | Flak et al. | |
| 2013/0168157 | A1 | 7/2013 | Belnap | |
| 2013/0264124 | A1 | 10/2013 | Belnap | |

FOREIGN PATENT DOCUMENTS

| | | |
|---|---|---|
| CN | 102187049 | 9/2011 |
| CN | 102959177 | 3/2013 |
| CN | 104144876 | 11/2014 |
| WO | 2010/100629 | 9/2010 |

OTHER PUBLICATIONS

Hsieh, Chih-Chun, and Weite Wu. "Overview of intermetallic sigma (◆◆) phase precipitation in stainless steels." ISRN Metallurgy 2012 (2012).*
International Search Report and Written Opinion for PCT Patent Application No. PCT/US2015/066704, dated Apr. 12, 2016; 14 pages.
International Search Report and Written Opinion for PCT Patent Application No. PCT/US2015/066679, dated Apr. 12, 2016; 14 pages.
Office Action for Chinese Patent Application No. 201580078416.8, dated Feb. 25, 2019, no English translation; 6 pages.
Office Action for Canadian Patent Application No. 2982917, dated Oct. 1, 2018; 3 pages.
International Preliminary Report on Patentability for PCT Patent Application No. PCT/US2015/066679, dated Dec. 14, 2017; 10 pages.
Office Action for Canadian Patent Application No. 2982940, dated Jul. 31, 2018; 3 pages.
International Preliminary Report on Patentability for PCT Patent Application No. PCT/US2015/066704, dated Dec. 14, 2017; 8 pages.
Office Action for Chinese Patent Application No. 201580078416.8, dated Jun. 28, 2018, no English translation; 8 pages.
Office Action for Chinese Patent Application No. 201580078417.2, dated Sep. 26, 2018, no English translation; 9 pages.

* cited by examiner

FIG. 5
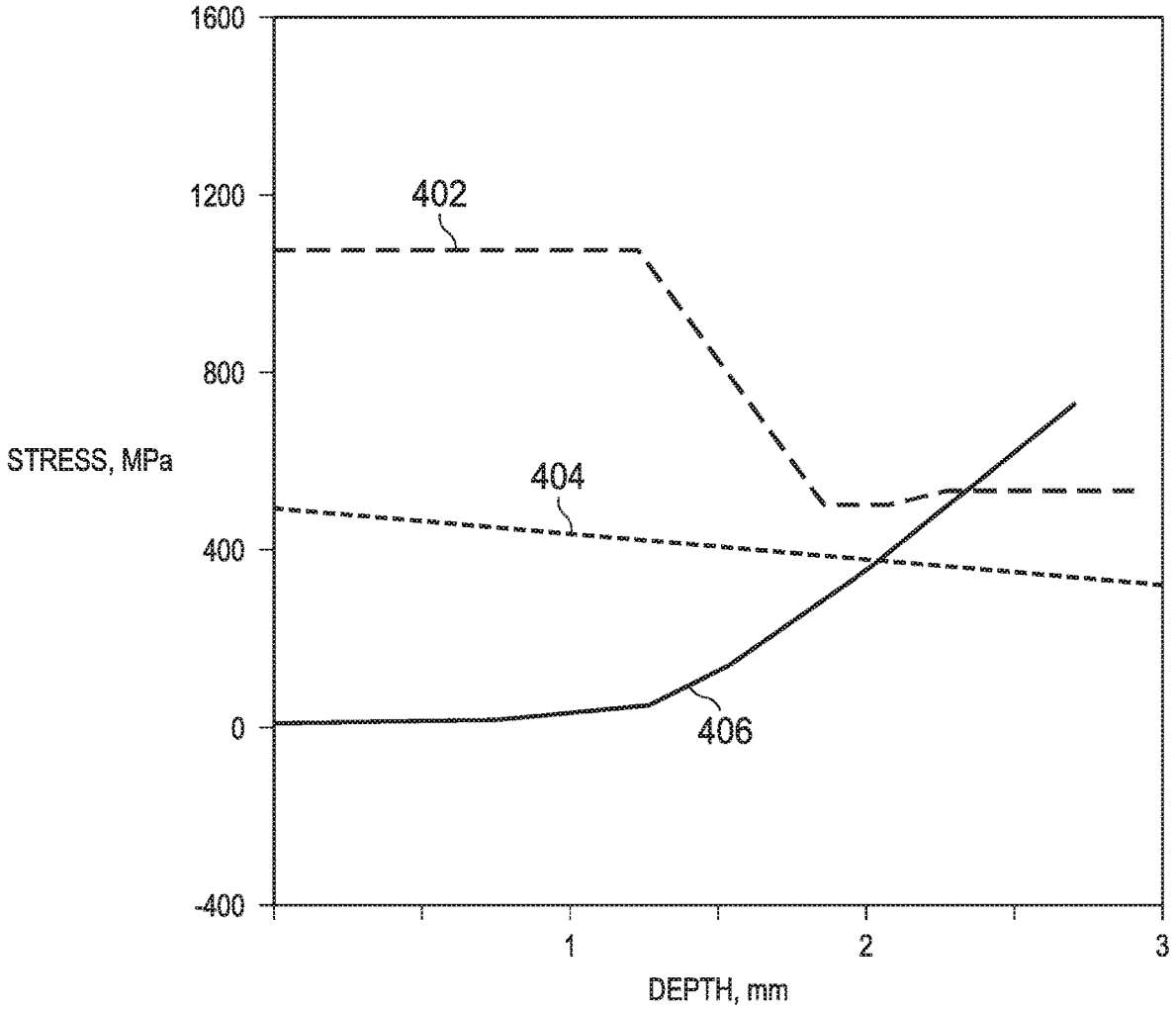
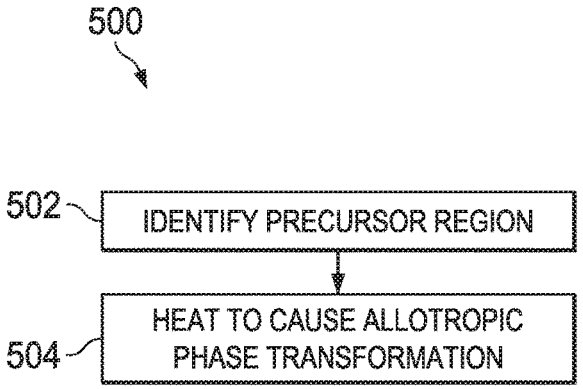
FIG. 6

COMPRESSIVE RESIDUAL STRESS-HARDENED DOWNHOLE TOOL SHAFT REGION

RELATED APPLICATIONS

This application is a U.S. National Stage Application of International Application No. PCT/US2015/066679 filed Dec. 18, 2015, which designates the United States, and claims priority to U.S. Provisional Application No. 62/171,398 filed Jun. 5, 2015, and to U.S. Provisional Application No. 62/171,393 filed Jun. 5, 2015, which are incorporated herein by reference in their entirety.

TECHNICAL FIELD

The present disclosure relates generally to downhole tools, such as rotary drill bits, with a compressive residual stress-hardened shaft region.

BACKGROUND

Various types of downhole tools are used to form wellbores in downhole formations. These downhole tools including rotary drill bits, reamers, core bits, under reamers, hole openers, and stabilizers. Rotary drill bits include fixed-cutter drill bits, roller cone drill bits, and hybrid drill bits. Rotary drill bits may be manufactured of materials such as polycrystalline diamond compact and metal-matrix composite (MMC). A rotary drill bit may include more than one type of material. For instance PDC drill bits are often also MMC drill bits.

BRIEF DESCRIPTION OF THE DRAWINGS

For a more complete understanding of the present invention and its features and advantages, reference is now made to the following description, taken in conjunction with the accompanying drawings, in which:

FIG. 5 is a graph of the fatigue strength and applied stress for the threaded connector shown in FIG. 2 when the threaded connector is subjected to a bending load; and FIG. 6 is a flow chart of a method for creating a compressive residual strength-hardened shaft region by causing an allotropic phase transformation in a precursor shaft region.

DETAILED DESCRIPTION

Figure 1:
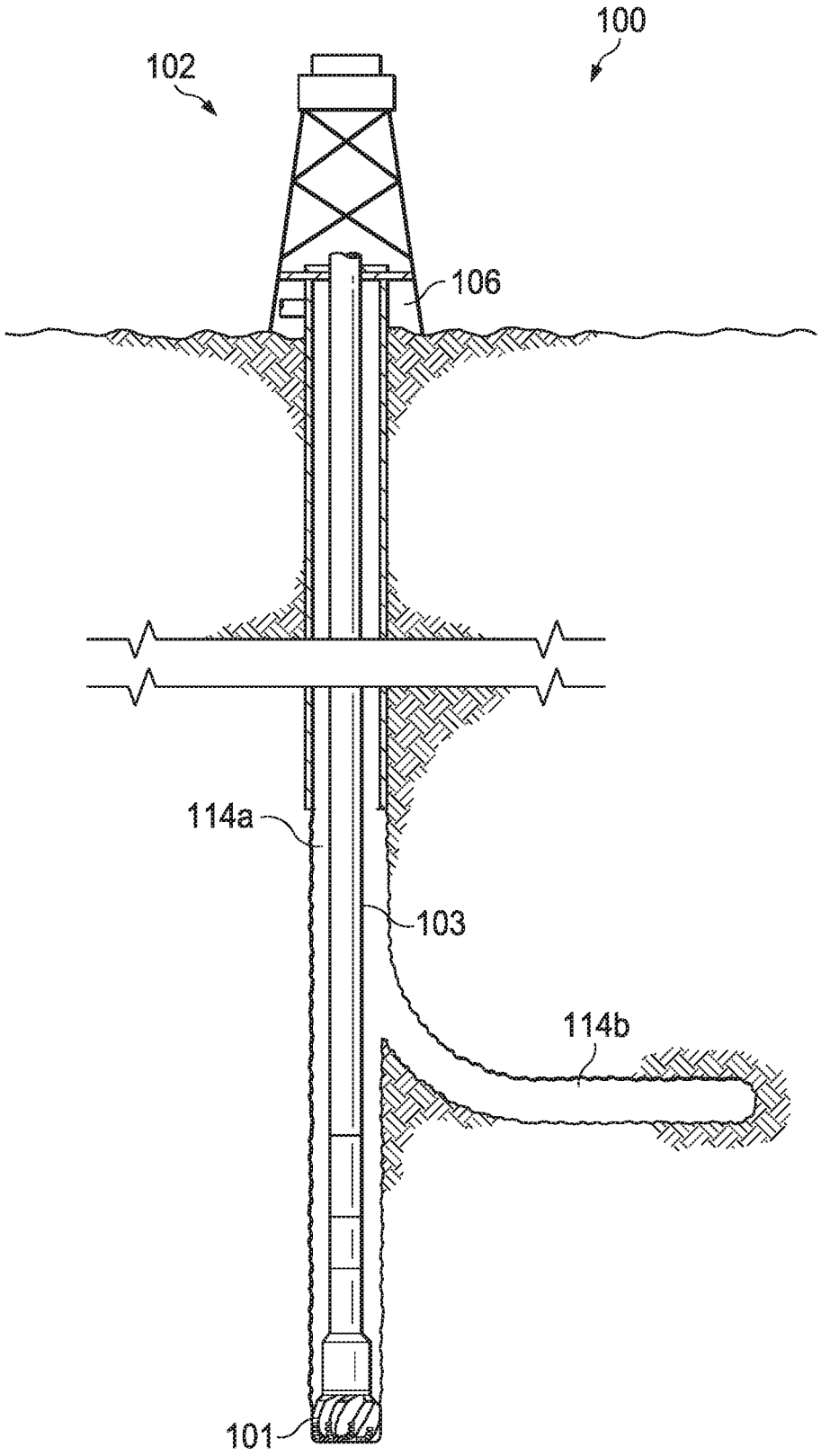
FIG. 1 is an elevation view of a drilling system in which a downhole tool containing a compressive residual strength-hardened region may be used.

During a drilling operation, various downhole tools, including drill bits, coring bits, reamers, hole enlargers, or combinations thereof may be lowered into a partially formed wellbore and used to further form the wellbore, for instance by drilling the wellbore deeper into a formation or by increasing the diameter of the wellbore. These downhole tools are subject to a variety of mechanical stresses, particularly during contact with the formation. For instance, the shaft of the drill bit may experience different stresses than the head of the bit. Different parts of the shaft may also experience different stresses from one another. The present disclosure provides a downhole tool, such as a drill bit, in which a region of the shaft, typically a metallic region, has been hardened by imparting a compressive residual stress to that region by causing an allotropic material in the region to undergo an allotropic phase transformation from a first allotrope to a second allotrope while forcing the second allotrope to occupy the same physical space as the first allotrope, thereby creating the compressive residual stress.

Allotropic materials can have two or more different physical structures while in the same physical state (i.e., solid, liquid, or gas). These different physical structures are referred to as allotropes. The present disclosure relates to allotropic materials with at least two allotropes in the solid state. Often different allotropes in the solid state have different crystal structures, although other differences in physical structure may be found in some allotropic materials. The different physical structures of different allotropes confer different physical properties. Graphite (pencil lead) and diamond are a readily understood examples of how different the physical properties of different allotropes may be. Although both materials are composed of nearly pure carbon, graphite may be flaked with a fingernail, while diamond is the hardest substance known. The difference is due entirely do the different crystal structures of the two different allotropes.

An allotropic phase transformation, as used herein, occurs when an allotropic material changes from one allotrope to another while remaining a solid and without reaction with another chemical. Typically, changing from one allotrope to another causes an increase or a decrease in the atomic packing density, a crystal lattice parameter (if at least one of the allotropes is a crystal), or both. An allotropic phase transformation may be caused by any number of conditions, which commonly include a threshold level of or amount of change in pressure, temperature, or both. For example, the graphite allotrope undergoes an allotropic phase transformation to the diamond allotrope, but only under very high temperature and pressure. Most allotropic phase transformations of interest in forming a downhole tool as disclosed herein do not require such extreme conditions.

Allotropic elements include Americium (Am), Beryllium (Be), Calcium (Ca), Cerium (Ce), Curium (Cm), Cobalt (Co), Dysprosium (Dy), Iron (Fe), Gadolinium (Gd), Hafnium (Hf), Holmium (Ho), Lanthanum (La), Manganese (Mn), Neodymium (Nd), Neptunium (Np), Promethium (Pm), Praseodymium (Pr), Plutonium (Pu), Sulfer (S), Scandium (Sc), Samarium (Sm), Tin (Sn), Strontium (Sr), Terbium (Tb), Thorium (Th), Titanium (Ti), Uranium (U), Yttrium (Y), Ytterbium (Yb), and Zirconium (Zr). Allotropic materials include alloys of any of these allotropic elements, such as steel (Fe—C), in which the allotropic element may still be present as at least two different allotropes.

Allotropes may be detected and distinguished from one another using any of a variety of known non-destructive or destructive measurement methods. For instance allotropes may be distinguished using X-ray diffraction.

According to the present disclosure, a precursor region is formed on a downhole tool shaft, which may include a region in an unthreaded part of the shank, in a threaded connector part of the shank, or a region in a mandrel (also sometimes referred to as a blank). The precursor region may be formed when the shaft is formed, prior to formation of a downhole tool on the shaft, during formation of a downhole tool on the shaft, or after formation the downhole tool on the shaft, but before use of the downhole tool. The precursor region includes an allotropic material that can undergo an allotropic phase transformation to cause a compressive residual stress in the region. For instance, the allotropic material in the precursor region may be a first allotrope with a higher packing density, at least one shorter lattice parameter (if a crystal), or both, than the second allotrope formed by the allotropic phase transformation. The allotropic material is a solid and is constrained in at least one dimension by the remainder of the shaft such that it occupies the same physical space as the first allotrope, so a compressive residual stress is created in the region.

For example, the precursor region may include the austenite allotrope of Fe, which has a face centered cubic (FCC) crystal structure. When the precursor region is cooled, the Fe undergoes an allotropic phase transformation to the ferrite allotrope, which has a body centered cubic (BCC) crystal structure. The ferrite allotrope of Fe has a higher packing density than the austenite allotrope, so a residual compressive stress in the region is created by the allotropic phase transformation. In other examples, after the Fe undergoes an allotropic phase transformation to a ferrite allotrope, the Fe may have entrapped carbon and have a body centered tetragonal (BCT) crystal structure.

Various methods for measuring compressive residual stress are known. Methods, such as X-ray diffraction and hardness profile testing, are compatible with measuring compressive residual stress in the present disclosure. X-ray diffraction may also be used to determine the allotrope present in any portion of the downhole tool. Although some testing may be non-destructive, such as X-ray diffraction measured on the surface of a region, other testing, such as testing of the interior of a region or hardness testing, may be destructive. If destructive testing is used to determine compressive residual stress of an allotrope, then representative samples may be used and the test results may be assumed to apply to other downhole tools of the same construction formed in the same way.

A compressive residual stress increases crack-resistance of a region as compared to a similar region that did not undergo an allotropic phase transformation or another region of the shaft that does not contain the allotropic material. Compressive residual stress helps arrest any cracks that may form or propagate by essentially squeezing the crack, especially at its ends. Crack-resistance may be measured using any of a number of known measurements techniques, which are usually not dependent on how the material was formed. Crack-resistance may focus on the ability to resist propagation of cracks that have formed, rather than the ability to resist formation of cracks in the first place. Cracks in a downhole tool may be detected using any of a number of known detection techniques including fluorescent-penetrant dye inspection, ultrasonic testing, and X-ray testing.

A compressive residual stress in a region may also improve its erosion resistance, stiffness, strength, toughness, or any combination thereof. These improved properties may be achieved instead of or in addition to improved crack-resistance as compared to a similar region that did not undergo an allotropic phase transformation or another region of the shaft that does not contain the allotropic material. These properties may also be measured using known measurement techniques, which are also not usually dependent on how the material was formed.

Typically the compressive residual stress-hardened region includes part of a surface of the shaft and also extends into the shaft. Typically, the compressive residual stress-hardened region extends into the shaft at least 0.1 mm, at least 1 mm, at least 10 mm, or at least 250 mm, as well as between any combinations of these endpoints. When the compressive residual stress-hardened region is annular, its thickness may depend on the external diameter of the shaft in the compressive residual stress-hardened region.

Although the downhole tools and methods discussed herein refer to a single precursor region and single compressive residual stress-hardened region for simplicity, a shaft, including a single part of the shaft, may include a plurality of such regions. Furthermore, different precursor regions or corresponding compressive residual stress-hardened regions or even the same precursor region or compressive residual stress-hardened region may contain different allotropic materials. In addition, different precursor regions and different compressive residual stress-hardened regions may be formed at different times and different types of heating or multiple heating steps may be used to cause an allotropic phase transformation in different precursor regions or different allotropic materials. Furthermore, although the allotropic material is referred to herein as occupying the same physical space after the allotropic phase transformation, some variation in physical dimensions, particularly in directions where the material is not constrained, may occur. Typically this variation in any direction will be less than 1% of the length of that direction, or the volume occupied by the first allotrope will not change by more than 10%.

Aspects of the present disclosure and its advantages may be better understood by referring to FIGS. 1 through 6, where like numbers are used to indicate like and corresponding parts.

FIG. 1 is an elevation view of a drilling system in which a downhole tool containing a hardened region may be used. Drilling system 100 includes a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole tools incorporating teachings of the present disclosure may be satisfactorily used with drilling equipment located on offshore platforms, drill ships, semi-submersibles, and/or drilling barges (not expressly shown).

When configured for use with a drill bit, drilling system 100 includes drill string 103 associated with drill bit 101, typically through a bottom hole assembly (BHA). The drilling system is used to form a wide variety of wellbores or bore holes such as generally vertical wellbore 114*a* or directional wellbore, such as generally horizontal wellbore 114*b*, or any combination thereof. Drilling system 100 may be configured in alternative ways for other downhole tools having a shaft.

In the present disclosure, drill bit 101 or another downhole tool in drilling system 100 includes a compressive residual stress-hardened region on its shaft. The compressive residual stress-hardened region may optimize drill bit 101 or other downhole tool for the conditions experienced during the drilling operation to increase the life span of drill bit 101 or other downhole tool. Although drill bit 101 is depicted as a fixed-cutter drill bit, any drill bit having a shaft with a compressive residual stress-hardened region may be used in drilling system 100.

Figure 2:
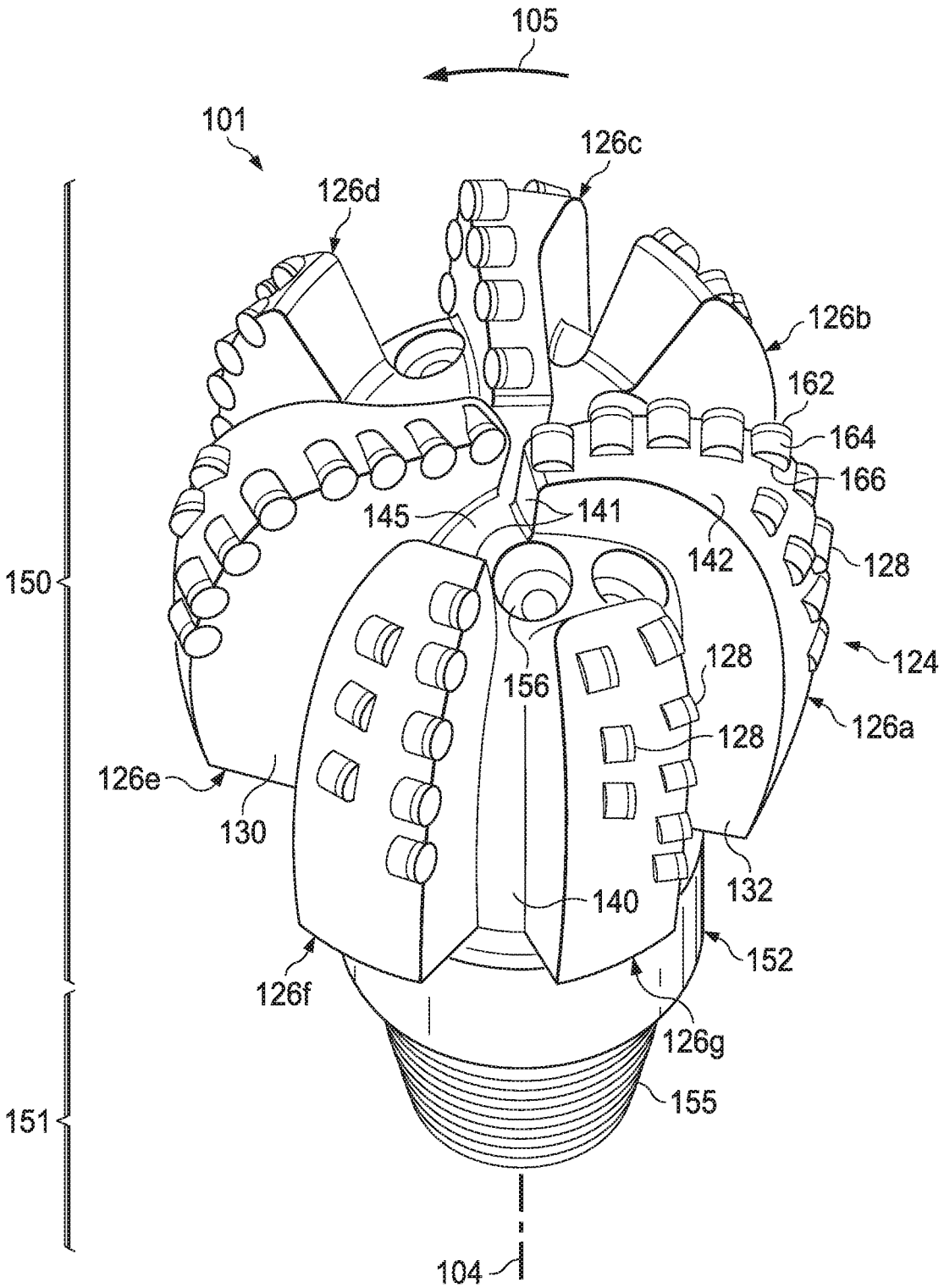
FIG. 2 is an isometric view of a fixed-cutter drill bit with a shank including a threaded connector oriented upwardly.
Figure 3:
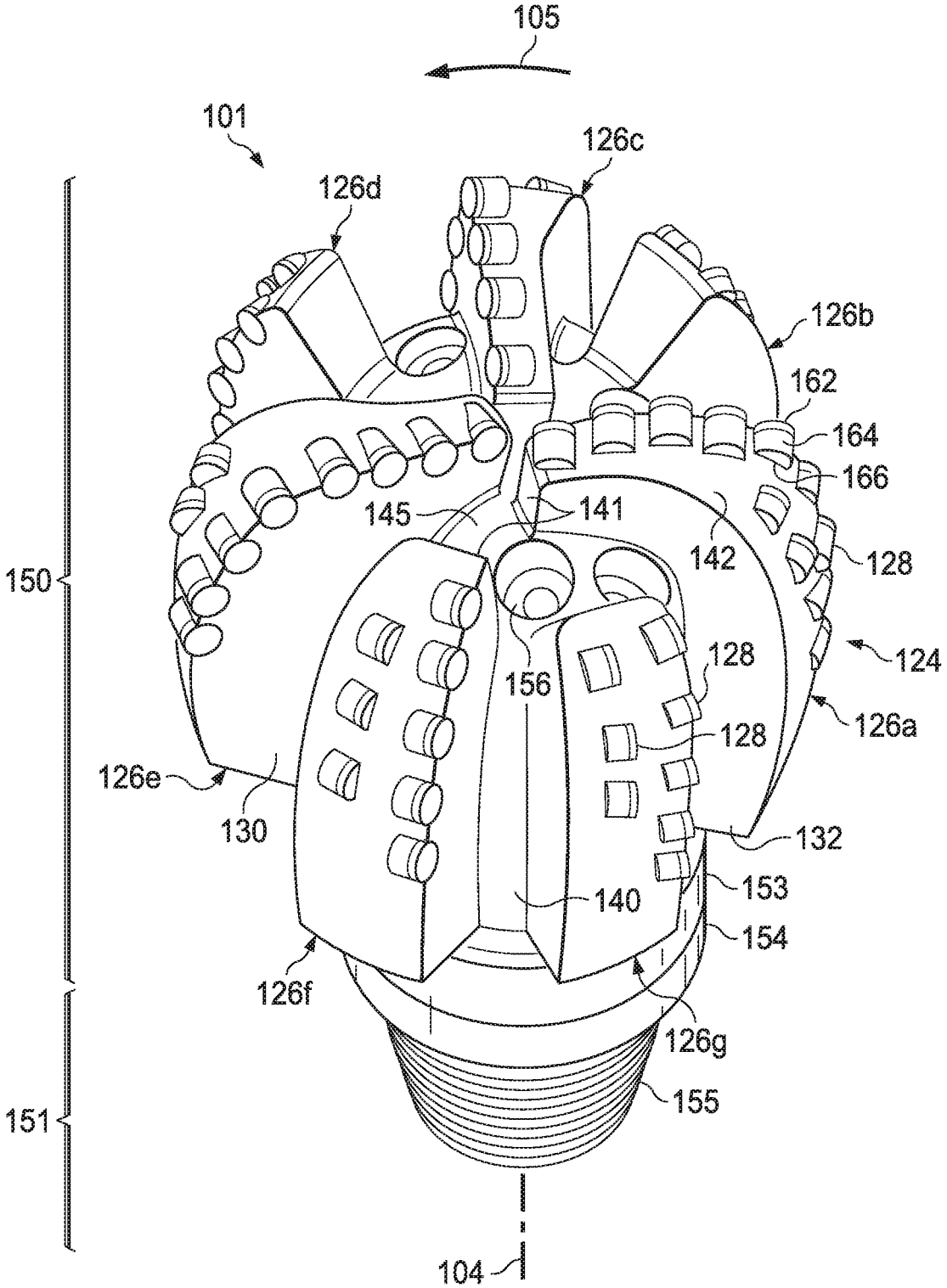
FIG. 3 is an isometric view of a fixed-cutter drill bit with a mandrel and a shank including a threaded connector oriented upwardly.

FIG. 2 and FIG. 3 are isometric views of fixed-cutter drill bits oriented upwardly. Drill bit 101 formed in accordance with teachings of the present disclosure may have many different designs, configurations, and dimensions according to the particular application of drill bit 101.

Figure 4:
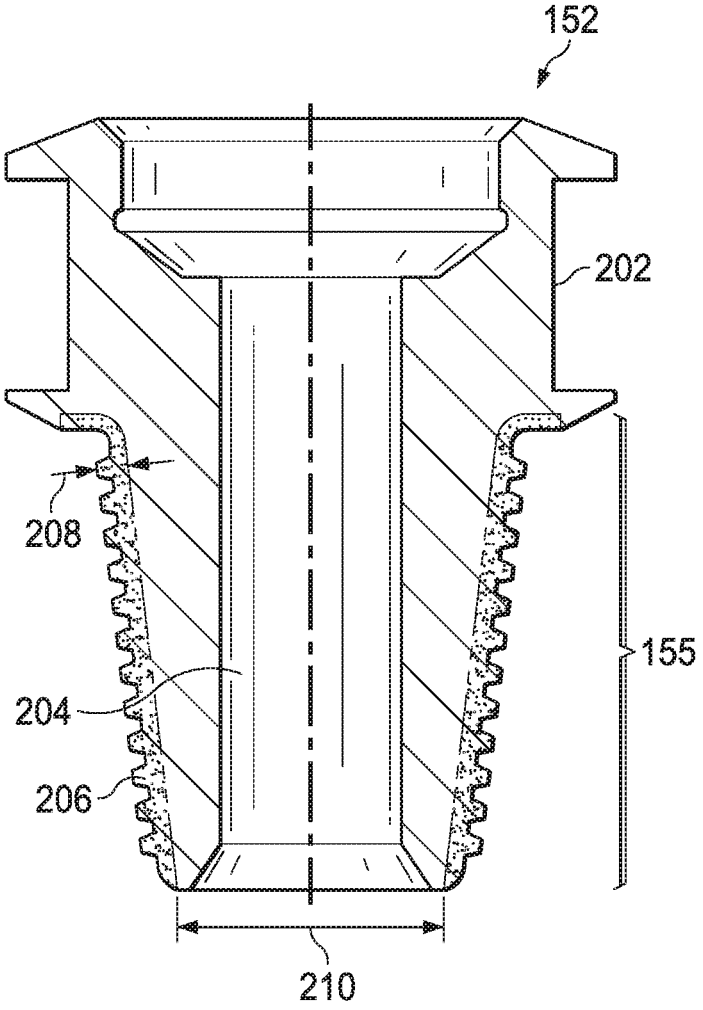
FIG. 4 is a cross-sectional view of the shank of the drill bit of FIG. 2 with a compressive residual strength-hardened threaded connector.

In FIG. 2, drill bit 101 includes shaft 151 and head 150. Shaft 151 includes shank 152 with threaded connector 155. Shank 152 is securely attached to head 150 such that it will not separate from head 150 during normal operation of drill bit 101. Shank 152 may be solid, but typically it contains a fluid-flow passageway as depicted in FIG. 4. Shank 152 or threaded connector 155 include at least one compressive residual stress-hardened region containing an allotrope of an allotropic material that creates at least a part of the compressive residual stress.

In FIG. 3, drill bit 101 also includes shaft 151 and head 150, but shaft 151 includes shank 152, threaded connector 155, and mandrel 153. Mandrel 153 is securely attached to head 150 such that it will not separate from head 150 during normal operation of drill bit 101. Shank 152 is securely attached to mandrel 153 such that it will not separate from mandrel 153 during normal operation of drill bit 101. For instance, shank 152 may be welded to mandrel 153, for example by weld 154 in an annular weld groove. Shank 152 may be solid, but typically it contains a fluid-flow passageway as depicted in FIG. 4. Mandrel 153 also may be solid, but typically contains a fluid-flow passageway similar to that of shank 152.

Referring again to both FIG. 2 and FIG. 3, threaded connector 155 [also referred to as an American Petroleum Institute (API) connector] may be used to releasable engage drill bit 101 with drill string 103 or FIG. 1, typically through the BHA. When engaged with drill string 103, drill bit 101 may be rotated relative to bit rotational axis 104. Threaded connector 155 includes threads that are machined into threaded connector 155. Threaded connector 155 may be welded to shank 152 after the allotropic phase transformation is complete.

Although any part of shaft 151, including multiple parts thereof, may contain a compressive residual stress-hardened region, typically a compressive residual stress-hardened region will be located at least on threaded connector 155. Furthermore, although shaft 151 or any part thereof may be formed from any material, typically shank 152, threaded connector 155, and mandrel 153 (if present) are formed from a metal or metal alloy.

Drill bit 101 includes head 150 including one or more blades 126*a*-126*g*, collectively referred to as blades 126, that are disposed outwardly from exterior portions of rotary bit body 124. Rotary bit body 124 may have a generally cylindrical body and blades 126 may be any suitable type of projections extending outwardly from rotary bit body 124. For example, a part of blade 126 may be directly or indirectly coupled to an exterior portion of bit body 124, while another part of blade 126 may be projected away from the exterior portion of bit body 124. Blades 126 formed in accordance with the teachings of the present disclosure may have a wide variety of configurations including substantially arched, helical, spiraling, tapered, converging, diverging, symmetrical, asymmetrical, or any combinations thereof.

Each of blades 126 may include a first end disposed proximate or toward bit rotational axis 104 and a second end disposed proximate or toward exterior portions of drill bit 101 (i.e., disposed generally away from bit rotational axis 104 and toward uphole portions of drill bit 101). Blades 126 may have apex 142 that may correspond to the portion of blade 126 furthest from bit body 124 and blades 126 may join bit body 124 at landing 145. Exterior portions of blades 126, cutters 128 and other suitable elements may be described as forming portions of the bit face.

Plurality of blades 126*a*-126*g* may have respective junk slots or fluid-flow paths 140 disposed therebetween. Drilling fluids are communicated through one or more nozzles 156.

Although bit body 124 and blades 126 may be formed from any material, typically they are formed from a reinforcement material infiltrated with a binder.

FIG. 4 is a cross-sectional view of shank 152 with a compressive residual strength-hardened region 206 on the exterior of threaded connector 155. Shaft 152 also includes unthreaded part 202 and fluid-flow passage 204. Thickness 208 of compressive residual strength-hardened region 206 may be a function of diameter 210 of threaded connector 155. For example, as diameter 210 increases, thickness 208 may also increase. As a general rule, thickness 208 may be approximately one-sixth of diameter 206.

Compressive residual strength-hardened region 206 may have a higher crack resistance, a higher erosion resistance, a greater stiffness, a greater strength, a greater toughness or any combination thereof as compared to unthreaded part 202. Compressive residual strength-hardened region 206, particularly when combined with a softer underlying shank material, may result in an increased lifespan for threaded connector 155 as threaded connectors are prone to failure due to fatigue, overloading, or both.

FIG. 5 is a graph of the fatigue strength and applied stress for threaded connector 155 shown in FIG. 4 when subjected to a bending load. The fatigue strength is shown as a function of depth from the surface of threaded connector 155 by line 402. Throughout compressive residual strength-hardened region 206, the fatigue strength remains high at approximately 1100 MPa. At approximately 1.5 millimeters from the surface, the hardening effects of compressive residual strength-hardened region 206 end and the fatigue strength decreases to approximately 460 MPa.

Line 404 illustrates the applied stress and line 406 illustrates the effective applied stress as a function of depth from the surface of threaded connector 155. Effective applied stress is the summation of applied stresses and residual stress at a particular depth from the surface. Due to the compressive residual stress in compressive residual strength-hardened region 206 at the surface and to a depth of 1.5 millimeters, the magnitude of the effective applied stress is less than the applied stress. Both the applied stress and the effective applied stress remain below the effective fatigue strength of threaded connector until approximately 2.4 millimeters below the surface. Therefore, crack initiation is delayed until this depth below the surface. In addition higher stresses are required to create a crack, thus creating crack-resistance in connector 155.

Prior to forming a compressive residual strength-hardened region, a precursor region is first formed on the shaft of downhole tool, such as a drill bit. The precursor region may be formed on the shaft prior to formation of the downhole tool including the shaft. The precursor region may be formed during formation of the downhole tool including the shaft. The precursor region may also be formed after formation of the downhole tool including the shaft. In addition, for a downhole tool containing multiple precursor regions, the precursor regions may be formed at different times.

In some examples, if the shaft or a part of the shaft is formed from an allotropic material, the precursor region may simply be a region identified for allotropic phase transformation but otherwise no different than other parts of the shaft. In other examples, the precursor region may be attached to the shaft, for example by welding.

In other examples, the precursor region may include a coating. The coating may be any type of allotropic material discussed herein. In some examples, the coating may be an alloy of the material from which the shaft or relevant part thereof is made. Alternatively or additionally, the coating may include an alloy that controls the temperature at which the allotropic phase transformation occurs. The coating may be applied using any suitable application technique, including spraying the coating on the shaft in the precursor region, applying a metal foil to the precursor region, or dipping the precursor region into a liquid coating, or any combination thereof. Such a coating may also be diffused into the downhole tool.

In still other examples, the precursor region may be formed in the shaft by casting the shaft from at least two different materials, at least one of which is an allotropic material located in the precursor region.

Regardless of when or how it is formed, at some point prior to the completion of manufacturing and eventual use of the downhole tool, the precursor region is subjected to heat to cause an allotropic phase transformation of the allotropic material, forming a compressive residual stress-hardened region in place of the precursor region.

FIG. 6 is a flow chart of one such method 500. The steps of method 500 may be performed by a person or manufacturing device that is configured to identify precursor regions and create conditions that transform the allotropic phase of the allotropic material in that region. Either the person or the manufacturing device may be referred to as a manufacturer.

In step 502 the manufacturer identifies a precursor region on shaft 151, particularly on a metallic portion of shaft 151. The precursor region includes a first allotrope of an allotropic material identified herein. In step 504, the precursor region is heated to cause an allotropic phase transformation, which forms a compressive residual strength-hardened region with a second allotrope of the allotropic material.

Heating may include induction, flame, laser, electron beam, thermal radiation, convection, friction, or combinations thereof. Induction heating is the process of heating an object through electromagnetic induction. Flame heating is the process of heating an object by exposing the object to a torch or flame. Laser heating is the process of heating an object with a laser beam. Electron beam heating is the process of heating an object by exposing an object to an electron beam. Thermal radiation heating is the process of an object by exposing the object to heat radiating off of another object. Convection heating is the process of heating an object by exposing the object to air currents that have been circulated over a heating element. Friction heating is the process of heating an object by exposing the object to heat generated by friction between the object and another object. Another trigger condition is the combination of heating and quenching where the allotropic material is heated followed by quenching to rapidly cool the allotropic material to finish the allotropic phase transformation.

Heating may also or alternatively include carburizing, nitridizing, boronizing, or combinations thereof. Carburizing, nitridizing, and boronizing further increase the compressive residual stress by introducing carbon (C), nitrogen (N), or boron (B) as an interstitial element in the compressive residual strength-hardened region. In any of the three processes, the allotropic material is heated in the presence of another material with a high carbon, nitrogen, or boron content for carburizing, nitridizing, or boronizing, respectively. The amount of carbon, nitrogen, or boron content absorbed by the allotropic material varies based on the temperature to which the material is heated and the elapsed time of the heating. Additionally, higher temperatures and longer elapsed time may increase the depth of interstitial element absorption in the allotropic material. After heating, the precursor region is rapidly cooled to cause an allotropic phase transformation in the allotropic material.

The compressive residual stress in the compressive residual strength-hardened region may also be further increased by shot peening the region or the part of the shaft containing the region. During shot peening, the surface of the precursor region is impacted by hard particles with a force sufficient to cause the surface to be plastically deformed. The plastic deformation creates a compressive residual stress on the surface and also creates tensile stress in the interior. Other trigger conditions may include cooling, applied stress (compressive or tensile), crack propagation, or an applied strain.

Embodiments disclosed herein include:

A. A downhole tool including a compressive residual stress-hardened shaft region in which the compressive residual stress results at least in part from a second allotrope of an allotropic material occupying the same physical space as was occupied by a first allotrope of the allotropic material prior to an allotropic phase transformation.

B. A drilling system including a drill string and the downhole tool of Embodiment A.

C. A method of hardening a shaft region of a downhole tool by heating a precursor region on the shaft to transform a first allotrope of an allotropic material in the precursor region to a second allotrope in the same physical space, thereby causing a compressive residual stress in the precursor region and hardening it to form a corresponding compressive residual stress-hardened region. The method may be used to form the downhole tool of Embodiments A and B.

D. A downhole tool manufactured by a process including heating a precursor region on the shaft to transform a first allotrope of an allotropic material in the precursor region to a second allotrope in the same physical space, thereby causing a compressive residual stress in the precursor region and hardening it to form a corresponding compressive residual stress-hardened region E. A method of surface hardening a drill bit including selecting a region on a surface of a metallic portion of a drill bit, processing the surface of the metallic portion at the selected region to transform the surface using an allotropic phase transformation, and creating a hardened region at the surface of the metallic portion at the selected region to confer a selected physical property at the selected region.

Each of embodiments A, B, C, D, and E may have one or more of the following additional elements in any combination, so long as such combination is not clearly impossible: i) the second allotrope may have a decreased atomic packing density as compared to the first allotrope; ii) the thickness of the hardened region may vary with the diameter of the shank, threaded portion, or mandrel; iii) the allotropic material may include Americium (Am), Beryllium (Be), Calcium (Ca), Cerium (Ce), Curium (Cm), Cobalt (Co), Dysprosium (Dy), Iron (Fe), Gadolinium (Gd), Hafnium (Hf), Holmium (Ho), Lanthanum (La), Manganese (Mn), Neodymium (Nd), Neptunium (Np), Promethium (Pm), Praseodymium (Pr), Plutonium (Pu), Sulfer (S), Scandium (Sc), Samarium (Sm), Tin (Sn), Strontium (Sr), Terbium (Tb), Thorium (Th), Titanium (Ti), Uranium (U), Yttrium (Y), Ytterbium (Yb), Zirconium (Zr), Am alloy, Be alloy, Ca alloy, Ce alloy, Cm alloy, Co alloy, Dy alloy, Fe alloy, Gd alloy, Hf alloy, Ho alloy, La alloy, Mn alloy, Nd alloy, Np alloy, Pm alloy, Pr alloy, Pu alloy, S alloy, Sc alloy, Sm alloy, Sn alloy, Sr alloy, Tb alloy, Th alloy, Ti alloy, U alloy, Y alloy, Yb alloy, or Zr alloy; iv) the first allotrope may include the austenite allotrope of iron (Fe) and has a face centered cubic (FCC) crystal structure; v) the second allotrope may include the ferrite allotrope of Fe and has a body centered cubic (BCC) crystal structure; vii) the second allotrope may include the ferrite allotrope of Fe with entrapped carbon (C) and has a body centered tetragonal (BCT) crystal structure; viii) the second allotrope may have a decreased atomic packing density as compared to the first allotrope, causing the compressive residual stress; ix) heating may include induction, flame, laser, electron beam, thermal radiation, convection, friction, or combinations thereof; x) heating may include carburizing, nitridizing, boronizing, or combinations thereof; xi) interstitial carbon, nitrogen, or boron may be introduced into at least the precursor region, thereby causing additional compressive residual stress in the corresponding compressive residual stress-hardened region; xii) at least the precursor region may also be shot peened, thereby causing additional compressive residual stress in the corresponding compressive residual stress-hardened region, xiii) the precursor region may be welded to the shaft; xiv) the shaft may be coated to form the precursor region; xv) the coating may be formed by spraying it on the shaft in the precursor region, by applying a metal foil to the precursor region, or by dipping the precursor region into a liquid coating, or any combination thereof; xvi) the coating may include an alloy that controls the temperature at which the first allotrope transforms to the second allotrope.

Although the present disclosure and its advantages have been described in detail, it should be understood that various changes, substitutions and alterations can be made herein without departing from the spirit and scope of the disclosure as defined by the following claims. It is intended that the present disclosure encompasses such changes and modifications as fall within the scope of the appended claims. For instance, one of ordinary skill in the art may apply the teachings herein to other downhole tool portions also containing metal, such as portions of the bit head containing metal. Such other metallic downhole tool portions may have compressive residual stress-hardened regions similar to those described herein for the shaft and formed using the methods described herein.

What is claimed is:

1. A method of hardening a shaft region of a downhole tool, the method comprising:

forming a precursor region including an austenite allotrope of iron (Fe) on a first portion of a surface of a shaft region of a downhole tool; and heating the precursor region on the first portion of the surface of the shaft region to transform the austenite allotrope of Fe in the precursor region to a second allotrope in the same physical space, thereby causing a compressive residual stress in the precursor region and hardening it to form a corresponding compressive residual stress-hardened region.

2. The method of claim 1, wherein the second allotrope has a decreased atomic packing density as compared to the austenite allotrope of Fe, causing the compressive residual stress.

3. The method of claim 1, wherein heating comprises induction, flame, laser, electron beam, thermal radiation, convection, friction, or combinations thereof.

4. The method of claim 1, wherein heating comprises carburizing, nitridizing, boronizing, or combinations thereof.

5. The method of claim 4, further comprising introducing interstitial carbon, nitrogen, or boron into at least the precursor region, thereby causing additional compressive residual stress in the corresponding compressive residual stress-hardened region.

6. The method of claim 1, further comprising shot peening at least the precursor region, thereby causing additional compressive residual stress in the corresponding compressive residual stress-hardened region.

7. The method of claim 1, further comprising welding the precursor region to the shaft.

8. The method of claim 1, further comprising coating the first portion of the shaft to form the precursor region.

9. The method of claim 8, wherein coating comprises spraying the coating on the shaft in the precursor region, applying a metal foil to the precursor region, or dipping the precursor region into a liquid coating, or any combination thereof.

10. The method of claim 8, wherein the coating comprises an alloy that controls the temperature at which the austenite allotrope of Fe transforms to the second allotrope.

11. The method of claim 1, wherein the austenite allotrope of Fe and has a face centered cubic (FCC) crystal structure, and the second allotrope comprises the ferrite allotrope of Fe and has a body centered cubic (BCC) crystal structure.

12. The method of claim 1, wherein the austenite allotrope of Fe and has a face centered cubic (FCC) crystal structure, and the second allotrope comprises the ferrite allotrope of Fe with entrapped carbon (C) and has a body centered tetragonal (BCT) crystal structure.

13. A downhole tool manufactured by a process comprising:

forming a precursor region including an austenite allotrope of iron (Fe) on a first portion of a surface of a shaft region of a downhole tool; and heating the precursor region on the first portion of the surface of the shaft region to transform the austenite allotrope of Fe in the precursor region to a second allotrope in the same physical space, thereby causing a compressive residual stress in the precursor region and hardening it to form a corresponding compressive residual stress-hardened region.

14. The downhole tool of claim 13, wherein the second allotrope has a decreased atomic packing density as compared to the austenite allotrope of Fe, causing the compressive residual stress.

15. The downhole tool of claim 13, wherein the austenite allotrope of iron (Fe) and has a face centered cubic (FCC) crystal structure, and the second allotrope comprises the ferrite allotrope of Fe and has a body centered cubic (BCC) crystal structure.

16. The downhole tool of claim 13, wherein the austenite allotrope of iron (Fe) and has a face centered cubic (FCC) crystal structure, and the second allotrope comprises the ferrite allotrope of Fe with entrapped carbon (C) and has a body centered tetragonal (BCT) crystal structure.

17. The downhole tool of claim 13, wherein a thickness of the compressive residual stress-hardened region varies with a diameter of the shaft, a diameter of a threaded portion, or a diameter of a mandrel.

18. The downhole tool of claim 13, wherein the precursor region is welded on the shaft.

19. The downhole tool of claim 13, wherein the precursor region is coated on the first portion of the shaft.

* * * * *